US011382406B2

(12) United States Patent
Blackwell

(10) Patent No.: US 11,382,406 B2
(45) Date of Patent: Jul. 12, 2022

(54) CUSTOMIZABLE TOOL BELT AND METHODS OF MAKING AND USING THE SAME

(71) Applicant: Terrance Blackwell, Whitsett, NC (US)

(72) Inventor: Terrance Blackwell, Whitsett, NC (US)

( * ) Notice: Subject to any disclaimer, the term of this patent is extended or adjusted under 35 U.S.C. 154(b) by 0 days.

(21) Appl. No.: 17/222,555

(22) Filed: Apr. 5, 2021

(65) Prior Publication Data

US 2021/0307493 A1 Oct. 7, 2021

Related U.S. Application Data

(60) Provisional application No. 63/005,605, filed on Apr. 6, 2020.

(51) Int. Cl.
*A45F 5/02* (2006.01)

(52) U.S. Cl.
CPC ..... *A45F 5/021* (2013.01); *A45F 2200/0575* (2013.01)

(58) Field of Classification Search
CPC ..... A45F 5/021; A45F 2200/0575
USPC ..... 224/660, 663, 665, 666, 667, 668, 671, 224/672, 674, 682, 904
See application file for complete search history.

(56) References Cited

U.S. PATENT DOCUMENTS 5,341,975 A * 8/1994 Marinescu ..... A45F 5/02 224/684
5,497,923 A * 3/1996 Pearson ..... A41F 9/002 224/648
5,501,379 A * 3/1996 Munoz ..... B25H 3/00 224/684
5,683,022 A * 11/1997 Evans ..... A45F 5/02 224/672
5,699,943 A * 12/1997 Schaefer ..... A45F 5/02 362/108
5,833,095 A * 11/1998 Russell ..... A45F 5/02 224/684
6,662,373 B2 * 12/2003 Frank ..... A45F 5/02 24/DIG. 54
8,474,673 B2 * 7/2013 Murdoch ..... A45F 5/02 224/675
8,985,411 B2 * 3/2015 Mongan ..... A45F 5/021 224/195
2002/0096545 A1 * 7/2002 Chang ..... A45F 5/02 224/904
2007/0181627 A1 * 8/2007 Simonin ..... B25H 3/006 224/904
2011/0084107 A1 * 4/2011 Reyes ..... A45F 5/02 224/666

* cited by examiner

*Primary Examiner* — Justin M Larson
(74) *Attorney, Agent, or Firm* — Dogwood Patent and Trademark Law; Ashley D. Johnson

(57) ABSTRACT

The invention is directed to a tool belt that can be used for holding and securing one or more tools or accessories commonly used with in the construction space (e.g., concrete or masonry). The tool belt comprises an elongated strap that is designed to be attached around the waist of a user. The strap includes a closure that allows the belt to be worn and removed as desired. The strap further includes one or more inserts that are added and removed from the belt as needed to customize the belt design. Each insert includes a protrusion that cooperates with a corresponding receiver configured on the belt strap. In this way, inserts can be added and removed from the belt for a particular job as needed by the user.

20 Claims, 12 Drawing Sheets

CUSTOMIZABLE TOOL BELT AND METHODS OF MAKING AND USING THE SAME

CROSS-REFERENCE TO RELATED APPLICATIONS

This application claims priority to U.S. Provisional Patent Application No. 63/005,605 entitled "Concrete Tool Belt," filed Apr. 6, 2020, the entire content of which is hereby incorporated by reference.

TECHNICAL FIELD

The presently disclosed subject matter is generally directed to a customizable tool belt for use with a variety of tools and accessories. The subject disclosure also includes methods of making and using the disclosed tool belt.

BACKGROUND

Construction workers often wear tool belts when they are on a construction site to hold one or more tools or accessories. Conventional tool belts typically include a belt portion that goes around the waist of a user, fastened with a buckle or similar closure. Conventional tool belts also typically include pouches or other receptacles for containing one or more desired items, such as pens, tape measures, nails, screws, drill bits, and other similar items often needed while working. In addition, a variety of holsters are frequently included on standard tool belts, sized and shaped to accommodate hammers, screwdrivers, or other tools that the user commonly needs on the job site. However, prior art tool belts are limited in design to the particular arrangement of pouches and holsters permanently provided on the belt. If the user requires additional pouches, for example, he is required to wear an additional tool belt or store the items in his hand or on the ground. As a result, user may spend considerable time going back and forth between a toolbox and the worksite to have access to all of the tools needed for a particular job. In addition, conventional tool belts may be unable to support specific items related to specialized jobs, such as concrete work or masonry. It would therefore be beneficial to provide a tool belt with one or more pouches and holsters capable of being added or removed by the user depending on the user preferences and/or a particular job to be performed.

SUMMARY

In some embodiments, the presently disclosed subject matter is directed to a customizable tool belt. Particularly, the tool belt comprises an elongate strap defined by a first end, a second end, a front face, and a rear face. The tool belt further includes a closure configured to releasably join the first and second ends. The strap includes a plurality of extensions, each extension defined by an interior passageway sized and shaped to allow the strap to pass therethrough and a latch positioned on one face of the extension, wherein the latch is moveable to pass through the face to extend into the interior passageway. The tool belt comprises one or more inserts, each insert defined by a front face and a rear face, a coupler configured to cooperate with an extension to releasably lock the insert into position on the front face of the strap, and at least one housing configured to retain at least a portion of a tool or accessory. The one or more inserts can be added or removed to the front face of the strap as desired by a user to create a customized tool belt.

In some embodiments, the strap has a length of about 20-60 inches and a width of about 0.5-2 inches.

In some embodiments, the strap is constructed from one or more of leather, suede, denim, nylon, polyester, canvas, synthetic leather, and fabric.

In some embodiments, the at least one extension latch protrudes from the front face of the strap at a distance of about 0.1-2 inches.

In some embodiments, the tool belt includes about 1-15 extensions.

In some embodiments, the extensions are uniformly or non-uniformly dispersed about the front face of the strap.

In some embodiments, wherein the closure is selected from a buckle, snap, clip, hook and loop closure, magnet, fastener, zipper, or combinations thereof.

In some embodiments, the rear face of the insert is planar or non-planar.

In some embodiments, the insert coupler is an aperture.

In some embodiments, the at least one housing is selected from one or more loops, hooks, open compartment, holster, pouch, closed pouch, closed compartment, or leg strap.

In some embodiments, the presently disclosed subject matter is directed to a method of customizing a tool belt. Specifically, the method comprises adding one or more desired inserts to the disclosed tool belt, wherein each insert is added to the tool belt by joining the insert coupler with a corresponding tool belt extension latch. In this way, the tool belt can be customized with one or more desired inserts.

In some embodiments, the presently disclosed subject matter is directed to a kit comprising a tool belt that includes an elongate strap defined by a first end, a second end, a front face, and a rear face. The tool belt also includes a closure configured to releasably join the first and second ends. The belt includes a plurality of extensions, each extension defined by an interior passageway sized and shaped to allow the strap to pass therethrough and a latch positioned on one face of the extension, wherein the latch is moveable to pass through the face to extend into the interior passageway. The kit comprises a plurality of inserts, each insert defined by a front face and a rear face. The insert further includes a coupler configured to cooperate with an extension to releasably lock the insert into position on the front face of the strap, and at least one housing configured to retain at least a portion of a tool or accessory. The one or more inserts can be added or removed to the front face of the strap as desired by a user to create a customized tool belt.

DETAILED DESCRIPTION

Figure 1A:
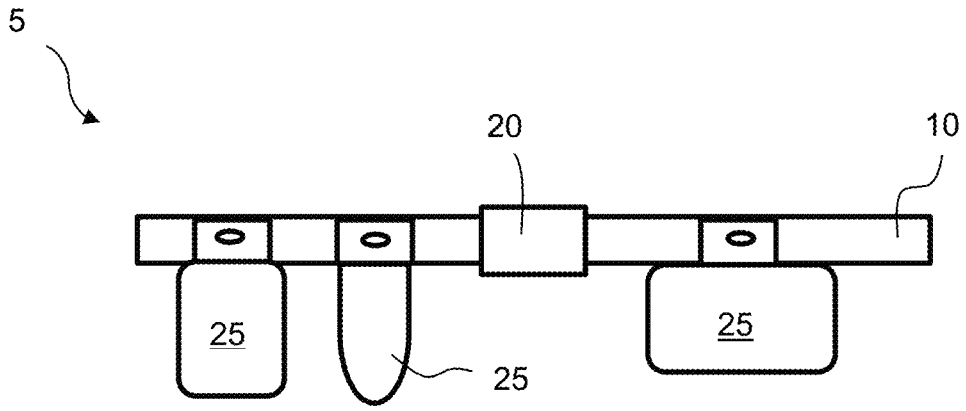
FIG. 1*a* is a front plan view of a customizable tool belt in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 1B:
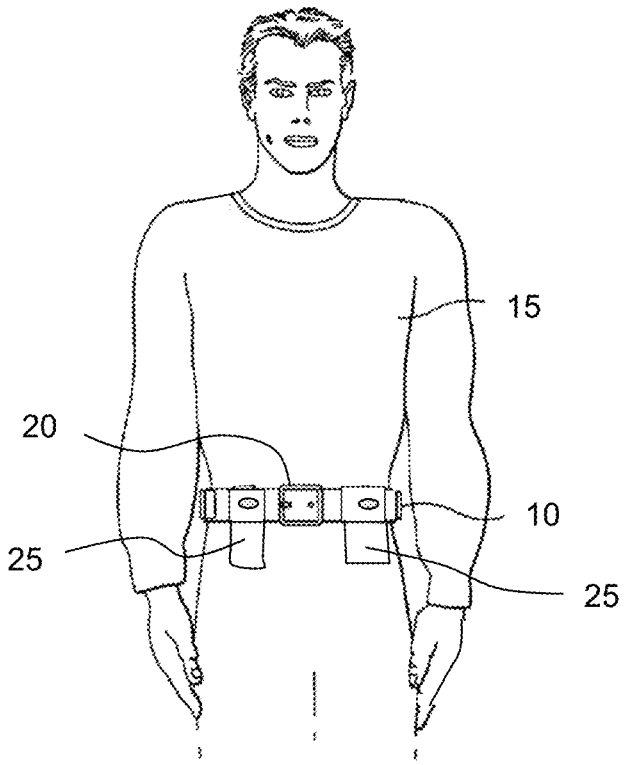
FIG. 1*b* is a front plan view of a user wearing a customizable tool belt in accordance with some embodiments of the presently disclosed subject matter.

The presently disclosed subject matter is generally directed to a tool belt that can be used for holding and securing one or more tools or accessories commonly used with in the construction space (e.g., concrete or masonry). The term "tool belt" as used herein broadly refers to any removable apparatus typically worn around the user's waist, configured to hold one or more tools and/or accessories. As shown in FIGS. 1*a* and 1*b*, tool belt 5 comprises elongated strap 10 that is designed to be attached around the waist of user 15. The strap includes closure 20, which allows the belt to be worn and removed as desired. The strap further includes one or more inserts 25 that are added and removed from the belt as needed to customize the belt design. As set forth in more detail below, each insert includes a coupler that cooperates with a corresponding extension configured on belt strap 10. In this way, inserts can be added and removed from the belt for a particular job as needed by the user.

Figure 2A:
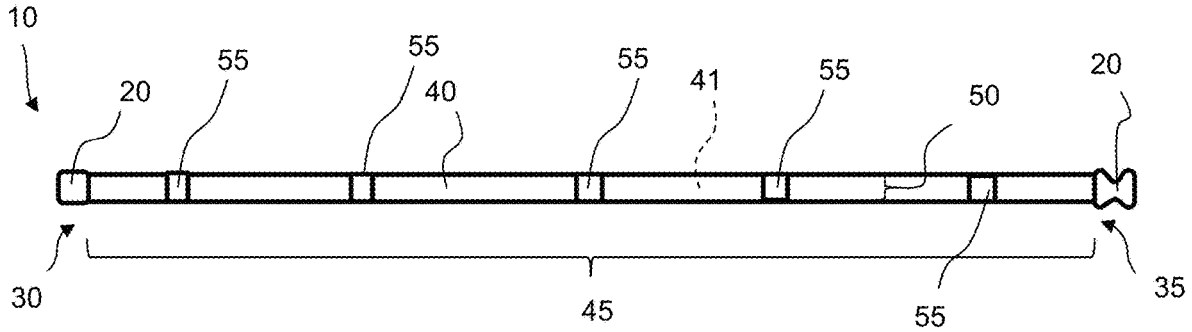
FIG. 2*a* is a top plan view of a customizable tool belt in accordance with some embodiments of the presently disclosed subject matter.
Figure 2B:
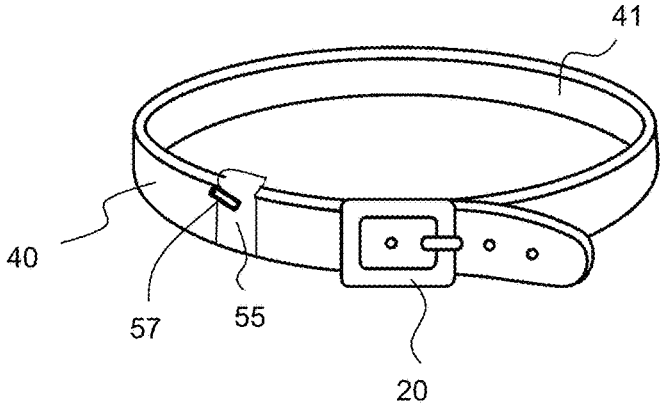
FIG. 2*b* is a perspective view of a customizable tool belt in a closed loop configuration in accordance with some embodiments of the presently disclosed subject matter.

FIG. 2*a* illustrates one embodiment of belt strap 10 comprising first end 30 and second end 35. The strap also includes front face 40 that extends toward the external environment and opposed rear face 41 that is adjacent to the user's body (e.g., waist). It is noted that the precise structure of strap 10 (and belt 5) can take many forms.

The belt strap can include any desired length 45 and width 50. The term "length" refers to the longest horizontal distance between first end 30 and second end 35. The term "width" refers to the longest vertical distance perpendicular to the length. In some embodiments, strap 10 can have length 45 of about 20-60 inches (e.g., at least/no more than about 20, 25, 30, 35, 40, 45, 50, 55, or 60 inches). In some embodiments, the strap can include a width of about 0.5-5 inches (e.g., at least/no more than about 0.5, 1, 1.5, 2, 2.5, 3, 3.5, 4, 4.5, or 5 inches). However, it should be appreciated that belt strap 10 is not limited and can include a length and width outside the ranges given herein. Further, the strap can have a constant width and/or length or can taper in the middle or at one or both ends.

Belt strap 10 can be constructed from any material that is capable of comfortably fitting against a user's body and that is sufficiently sturdy and tear-resistant to accommodate one or more tools. Suitable materials can include (but are not limited to) one or more of leather, denim, nylon, polyester, canvas, suede, synthetic leather, fabric (Cordura®, Spun-tuff®, etc.) and/or other similar materials. In some embodiments, strap 10 can be formed from a solid, continuous piece of material. Alternatively, the strap can include woven strands formed from one or more materials (leather, nylon, polyester, or the like).

Figure 3A:
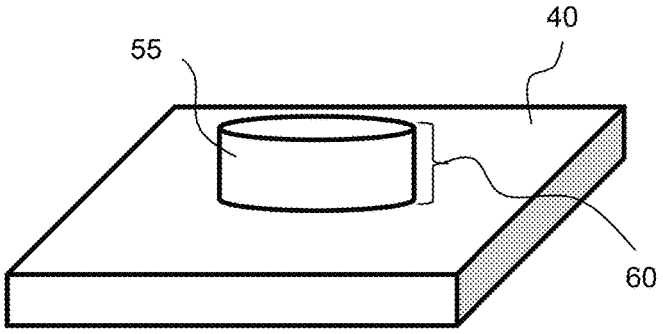
FIG. 3*a* is a fragmentary perspective view of a tool belt comprising an extension in accordance with some embodiments of the presently disclosed subject matter.

Strap 10 further comprises one or more extensions 55 that cooperate with corresponding couplers configured on inserts 25 to lock the insert into place along the length of the strap. Specifically, each extension removably attaches a desired insert to the belt strap. The term "extension" refers to any element that cooperates with a coupler to lock an insert into place along strap 10. FIG. 3*a* illustrates one embodiment of extension 55 configured as a protrusion that extends from the front face of the strap. Extension 55 can be constructed with any desired cross-sectional shape, such as (but not limited to) circular, oval, square, rectangular, triangular, hexagonal, pentagonal, octagonal, abstract, and the like. The extension can extend from front face 40 of the strap any suitable distance 60, such as about 0.1-2 inches (e.g., at least/no more than about 0.1, 0.25, 0.5, 0.75, 1, 1.25, 1.5, 1.75, or 2 inches).

Figure 3B:
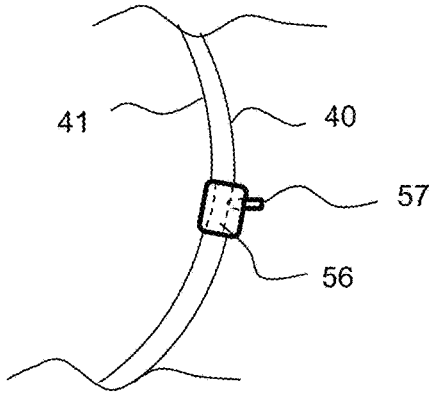
FIG. 3*b* is a side plan view of an extension with a strap threaded therethrough in accordance with some embodiments of the presently disclosed subject matter.
Figure 3C:
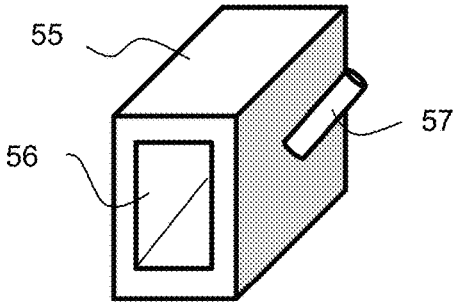
FIG. 3*c* is a perspective view of an extension in accordance with some embodiments of the presently disclosed subject matter.
Figure 3D:
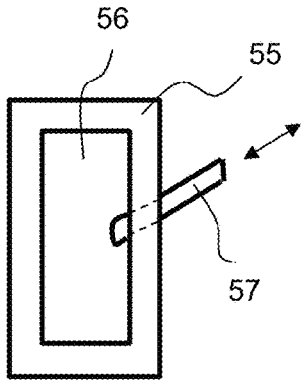
FIG. 3*d* is a cross sectional view of an extension and latch in accordance with some embodiments of the presently disclosed subject matter.

In some embodiments, the extension is configured such that the strap slides through the central portion thereof. For example, extension 55 can include an internal passageway 56 sized and shaped to allow the belt to pass therethrough, as shown in FIGS. 3*b*-3*d*. In this way, the extensions can be positioned and/or adjusted at any desired length along the strap, to further customize the belt as desired by the user. The internal passageway can fully extend through the length of the extension. It should be appreciated that the internal passageway can be constructed in any desired size and/or shape (e.g., oval, square, rectangular, etc.) so long as it allows a length of the strap to pass through.

Each extension can also include latch 57 that functions to lock the extension in place along the strap. While the latch can include any suitable mechanism for locking the extension in position on the strap, one embodiment is shown in in FIGS. 3*c* and 3*d*. Particularly, latch 57 can be configured as a rigid lever that presses into the strap material, thereby locking it into a desired location. In other words, the latch is positioned on a front surface of the extension and passes through the front extension face to directly contact the strap housed within passageway 56. Any conventional mechanism can hold the latch in the "locked" configuration (e.g., fasteners, press-fit, clips, pressure-fit, screw fit, etc.). Thus, the user can easily initiate the latch (e.g., press the latch to directly contact the strap) to lock an extension in position, or decouple the latch from the strap to move the extension along the length of the belt. The latch can have any desired shape and/or size, such as cylindrical, square, etc.

Extensions 55 and latch 57 can be constructed from any desired material, such as (but not limited to) metal, wood, plastic, or combinations thereof.

Figure 3E:
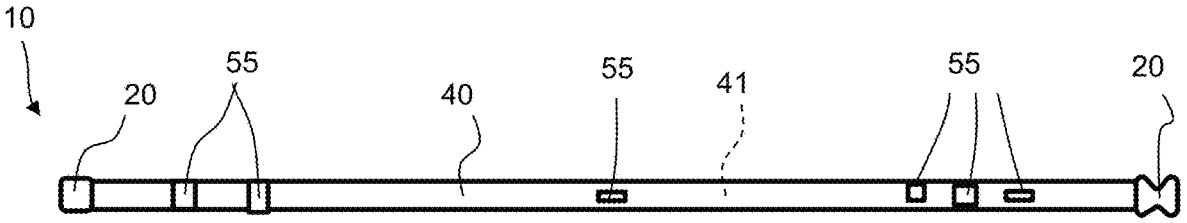
FIG. 3*e* is a top plan view of a tool belt in accordance with some embodiments of the presently disclosed subject matter.

Belt strap 10 can include any number of extensions 55 that extend fully or partially along length 45. In this way, corresponding inserts can be attached to the strap and utilized so long as there is sufficient space to attach the inserts. For example, the belt can include about 1-15 extensions (e.g., at least/no more than about 1, 2, 3, 4, 5, 6, 7, 8, 9, 10, 11, 12, 13, 14, or 15). However, the presently disclosed subject matter is not limited and belt 5 can include any number of extensions. Further, the extensions can be added or removed as described by the user, such as by threading or unthreading via passageway 56 through the strap. The extensions can be uniformly dispersed along the length of strap 10 (e.g., with about the same distance between each extension). In other embodiments, the extensions can be clustered and/or non-uniformly dispersed along the length of the belt, as shown in the embodiment of FIG. 3*e*. The term "non-uniform" refers to an absence of symmetry in the spacing of at least one extension. Thus, a uniform dispersion can be defined as having a uniform distance between adjacent extensions. A non-uniform dispersion of extensions can have various differences between the adjacent extensions (e.g., at least/no more than about 0.1, 0.5, 1, 1.5, 2, 2.5, 3, 3.5, 4, 4.5, 5, 5.5, 6, 6.5, 7, 7.5, 8, 8.5, 9, 9.5, 10 or more inches between adjacent extensions).

In some embodiments, each extension on strap 10 can have about the same shape and/or size. However, the presently disclosed subject matter is not limited and the various extensions can differ in size, shape, material, etc. compared to at least one other extension.

Extensions 55 can be configured on the strap using any suitable mechanism. For example, the extensions can be attached to the strap through the use of adhesives, welding, magnets, VELCRO®, fasteners, clips, screws, bolts, sewing, and the like. Alternatively, the strap can pass through extension passageway 56 as described above. Thus, the extensions can be permanently affixed to the front face of the strap. Alternatively, one or more extensions can be moved along the length of the strap to create a suitable attachment location for an insert.

As set forth above, belt strap 10 further includes closure 20 that allows the belt to be added or removed from the body of a user. The term "closure" broadly refers to any element that can releasably join first and second ends 30, 35 together. In some embodiments, first fastener 65 is coupled to strap first end 30 and second fastener 66 is coupled to second end 35. The first and second fasteners can removably attach to each other, forming a loop in the belt. The first and second fasteners can be adjustable, allowing the circumference of the belt loop can be varied (i.e., to tighten or loosen the strap around a user's waist). However, it should be appreciated that a single fastener can be used in some embodiments.

Figure 4A:
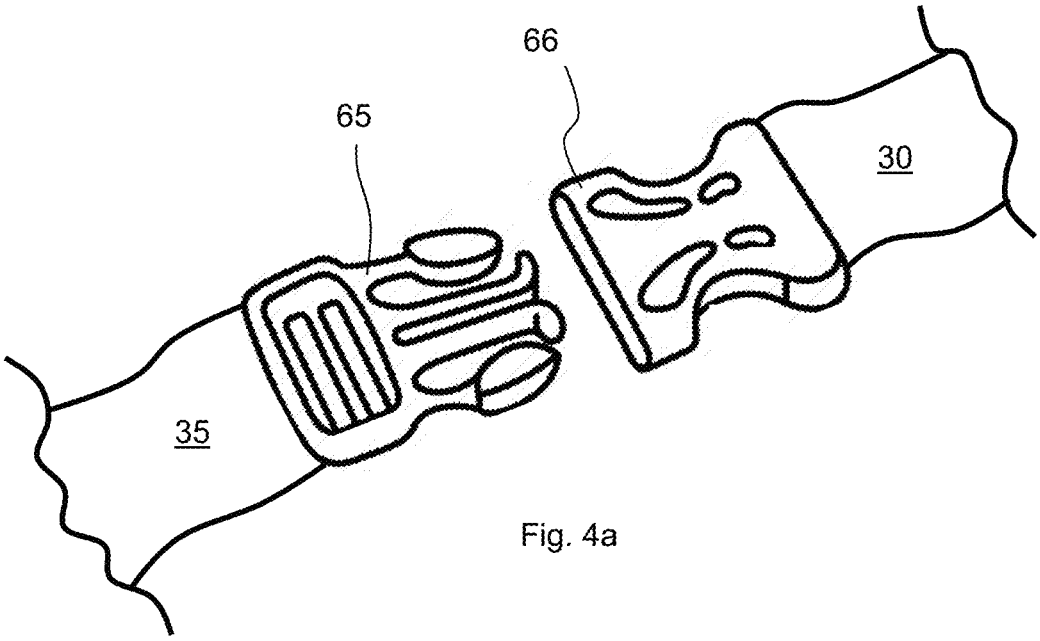
FIG. 4*a* is a front plan view of a tool belt closure in an open configuration in accordance with some embodiments of the presently disclosed subject matter.
Figure 4B:
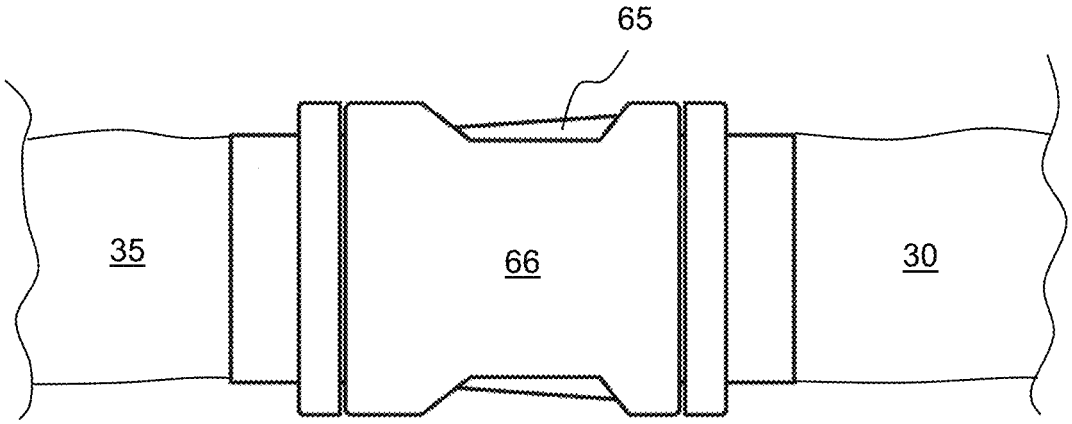
FIG. 4*b* is a front plan view of a tool belt closure in a closed configuration in accordance with some embodiments of the presently disclosed subject matter.

The closure can include any configuration that joins ends 30, 35 of the strap together. For example, the closure can be configured as a buckle with first and second fastener elements 65, 66 each attached to a respective end of the belt strap, as illustrated in FIG. 4*a*. The first fastener can at least partially fit within the interior of the second fastener, thereby releasably coupling the strap ends, as shown in FIG. 4*b*.

Figure 5A:
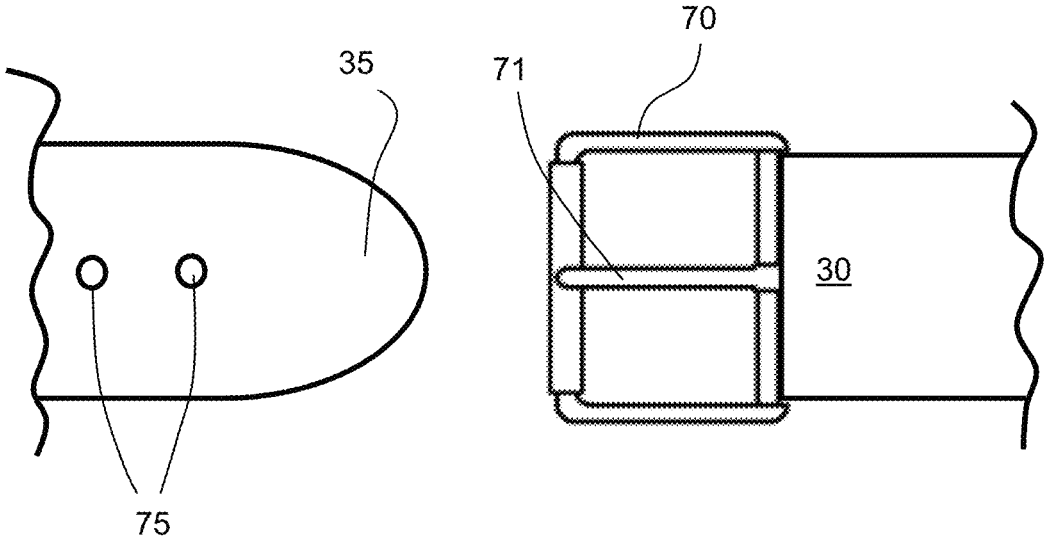
FIG. 5*a* is a front plan view of a tool belt closure in an open position in accordance with some embodiments of the presently disclosed subject matter.
Figure 5B:
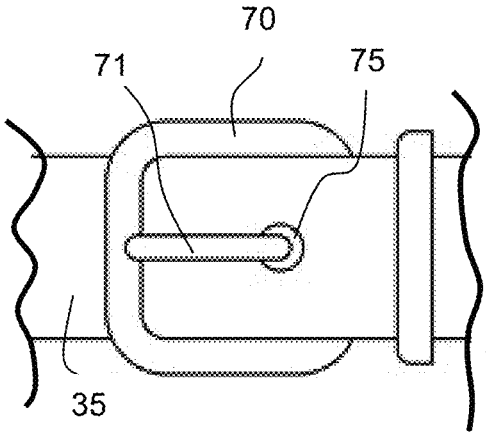
FIG. 5*b* is a front plan view of a tool belt closure in a closed position in accordance with some embodiments of the presently disclosed subject matter.

However, closure 20 is not limited and can include any of a wide variety of components. For example, one end of the belt strap can include single buckle 70 with arm 71 that cooperates with a series of openings 75 positioned on the opposing end of the strap, as shown in FIGS. 5*a* and 5*b*. Specifically, the buckle engages with an opening to maintain the tool belt in position.

Figure 5C:
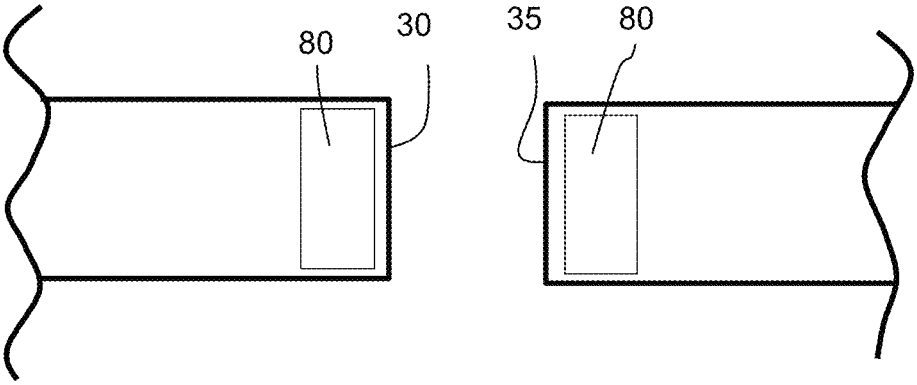
FIG. 5*c* is a front plan view of a tool belt closure comprising a plurality of magnets in accordance with some embodiments of the presently disclosed subject matter.
Figure 5D:
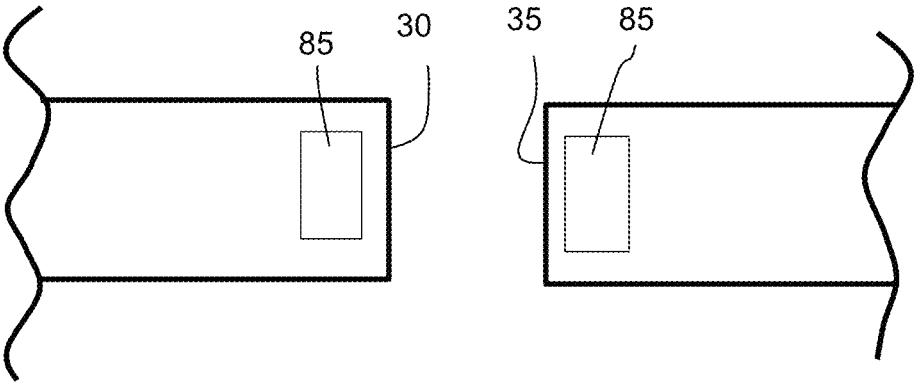
FIG. 5*d* is a front plan view of a tool belt closure comprising VELCRO® in accordance with some embodiments of the presently disclosed subject matter.

In other examples, each end of the belt strap can include magnet 80 configured such that the magnets are attractive, thereby coupling first and second strap ends 30, 31 together, as shown in FIG. 5*c*. Further, each strap end can utilize hook and loop closures (e.g., VELCRO® 85) to maintain the two ends of the strap together, as shown in FIG. 5*d*. It should also be appreciated that closure 20 can include any mechanical element, such as (but not limited to) clips, fasteners, screws, snaps, sockets, buttons, zippers, bolts, ties, and the like so long as they allow the two ends of the strap to be releasably joined.

Closure 20 can be constructed from any suitable material, such as metal (e.g., stainless steel, aluminum), plastic, wood, and the like.

Figure 6A:
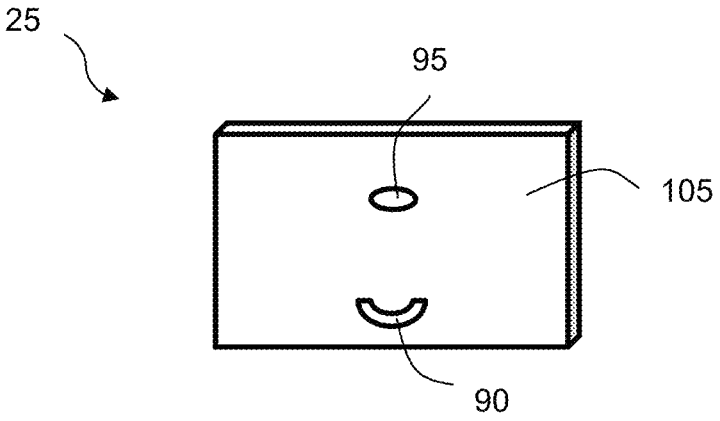
FIG. 6*a* is a perspective view of a tool belt insert in accordance with some embodiments of the presently disclosed subject matter.
Figure 6B:
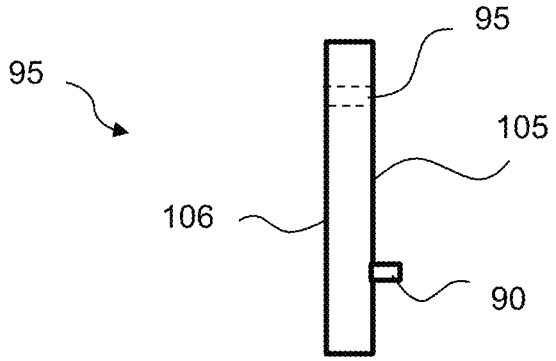
FIG. 6*b* is a side plan view of the tool belt insert of FIG. 6*a* in accordance with some embodiments of the presently disclosed subject matter.
Figure 6C:
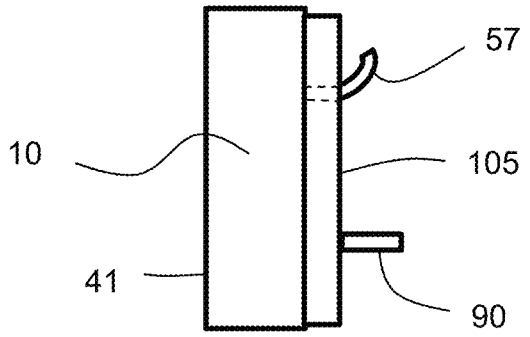
FIGS. 6*c* and 6*d* are side plan views of a tool belt insert and an associated belt strap in accordance with some embodiments of the presently disclosed subject matter.
Figure 6D:
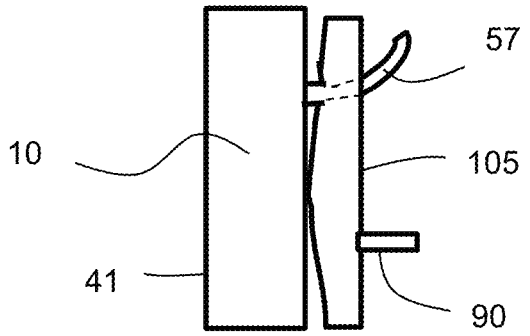

As described above, belt 5 also includes one or more inserts 25 that cooperate with extensions 55 on the belt strap. The term "insert" refers to any holder, pouch, container, pocket, holster, and the like configured to hold a tool or accessory (nail, pencil, pad, bolt, etc.). The term "tool" refers to any implement that can be used during the performance of a job, such a hammer, drill, wrench, chisel, etc. Each insert includes housing 90 that holds or partially encloses a tool or accessory and at least one coupler 95 that cooperates with the belt extension. In some embodiments, each insert includes a single coupler. However, an insert can include more than one coupler, such as to support large or heavy tools. As illustrated in FIGS. 6*a* and 6*b*, insert 25 can be configured with front surface 105 and an at least partially planar (e.g., even) rear surface 106 that is positioned adjacent to the front surface of belt strap 10. The planar rear surface therefore sits flush against the strap, allowing coupling between extension latch 57 and the aperture, as shown in FIG. 6*c*. However, the presently disclosed subject matter also includes embodiments wherein the front and/or rear surface of the insert is uneven (e.g., non-planar), as shown in the embodiment of FIG. 6*d*.

Figure 6E:
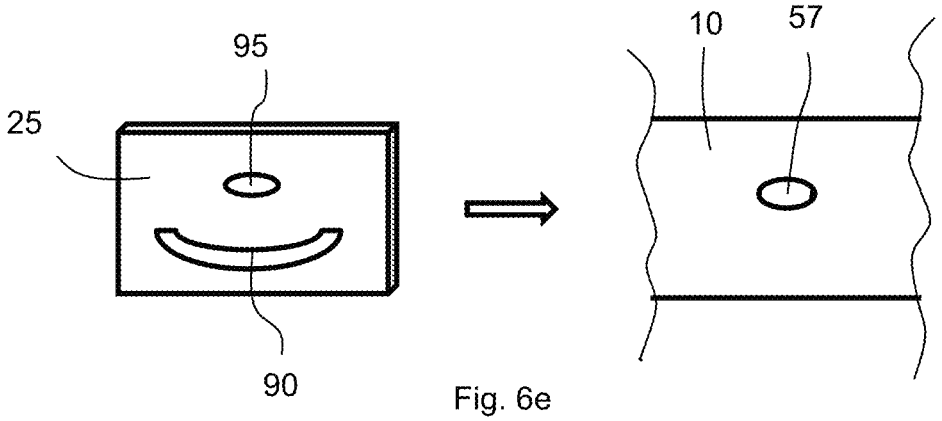
FIGS. 6*e* and 6*f* illustrate one method of attaching an insert to a tool belt in accordance with some embodiments of the presently disclosed subject matter.
Figure 6F:
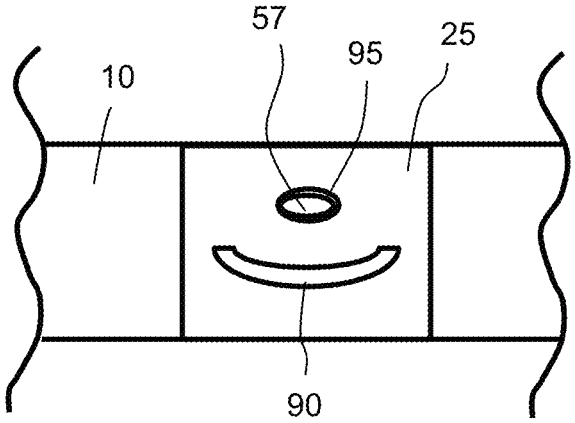

In some embodiments, the insert coupler can be configured as an aperture, although any element that cooperates with the extension latch to allow the insert to connect with the extension can be used. Thus, coupler 95 can be configured in any desired shape, such as (but not limited to) square, rectangular, circular, hexagonal, pentagonal, octagonal, diamond-shaped, abstract, and the like. FIGS. 6*e* and 6*f* illustrate one embodiment of insert coupler 95 cooperating with extension latch 57 to releasably connect the insert to the tool belt front face.

Figure 7A:
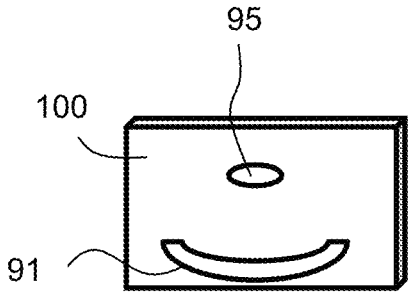
FIG. 7*a* illustrates a perspective view of a tool belt insert comprising a loop in accordance with some embodiments of the presently disclosed subject matter.
Figure 7B:
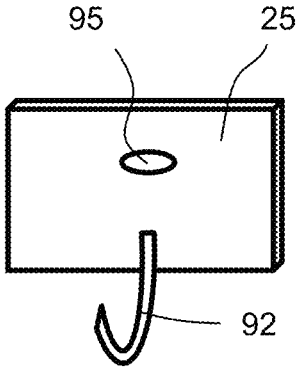
FIG. 7*b* is a perspective view of a tool belt insert comprising a hanger in accordance with some embodiments of the presently disclosed subject matter.
Figure 7C:
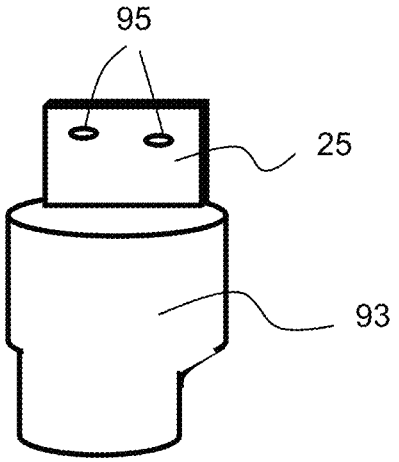
FIG. 7*c* is a perspective view of a tool belt insert comprising a holster in accordance with some embodiments of the presently disclosed subject matter.
Figure 7D:
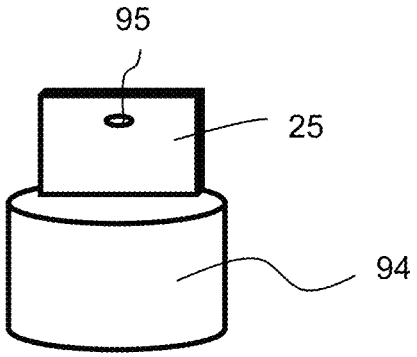
FIG. 7*d* is a perspective view of a tool belt insert comprising an open pouch in accordance with some embodiments of the presently disclosed subject matter.
Figure 7E:
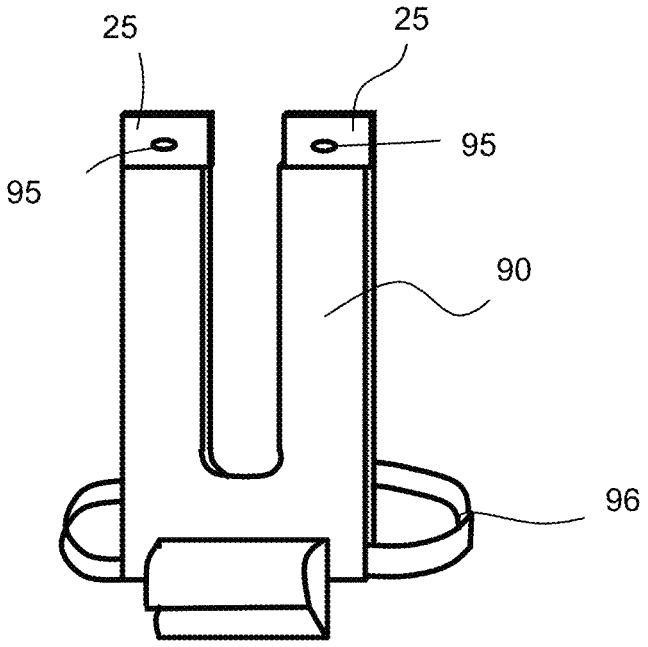
FIG. 7*e* is a perspective view of a tool belt insert comprising a pair of inserts, a leg strap, and a closed pouch in accordance with some embodiments of the presently disclosed subject matter.

FIG. 7*a* illustrates one embodiment of insert 25 comprising a housing configured as a full or partial loop 91, such as for the retention of a hammer. Particularly, a portion of a hammer (or other tool) can be easily inserted into the loop for easy storage and removal. In other embodiments, the housing can include hook 92, as depicted in FIG. 7*b*, suitable for holding a hand brush or other similar accessory. FIG. 7*c* illustrates one embodiment of an elongated housing that includes compartment 93 sized and shaped to accommodate a drill or other power tool in an easily accessible position proximate to a user's hip. The term "compartment" refers to an enclosure or holster of any size and/or shape and can have an open top or be closable (e.g., with a zippered top). The housing can further be constructed as open pouch 94, as shown in FIG. 7*d*, allowing the user to easily access items positioned within the pouch interior (e.g., nails, screws, bolts). FIG. 7*e* illustrates one embodiment of an insert comprising a pair of couplers 25 on a trowel holder. The insert can optionally include leg or arm strap 96 that allows the insert to be positioned around the user's leg or arm. In some embodiments, insert 25 can include closed pouch 97 that securely houses one or more items. It should therefore be appreciated that the housing can be constructed in a variety of different forms to accommodate one or more tools or accessories.

Figure 7F:
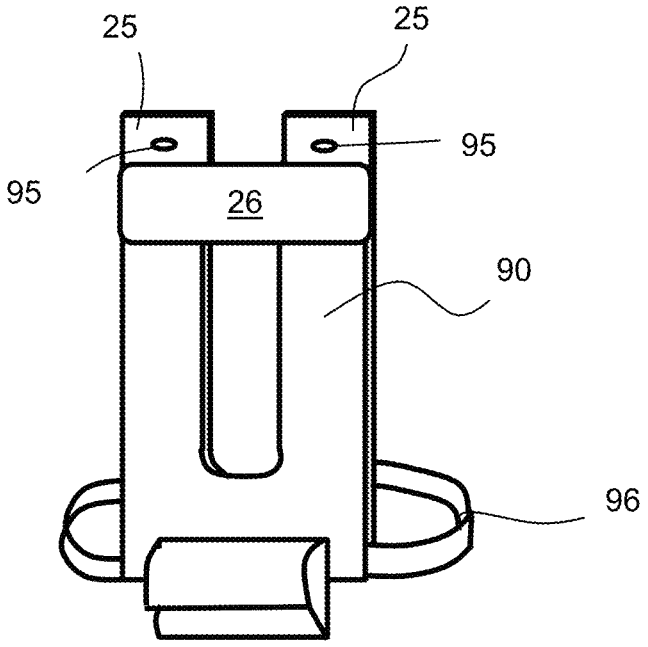
FIG. 7*f* is a perspective view of the tool belt of FIG. 7*e* comprising a protective flap in accordance with some embodiments of the presently disclosed subject matter.

Insert 25 can optionally include one or more protective elements to shield the user from injury. One example is illustrated in FIG. 7*f*. As shown, the insert can include flap 26 (e.g., trowel protection flap) used to shield the user from contact with a tool. The term "flap" refers to any protective element, such as one or more shields, tabs, folds, aprons, and the like. Thus, flap 26 can be configured as a section of material that is connected or integrally formed with adjacent material at a side or end. The flap can therefore include one free, unsecured end. However, the flap can have any desired configuration that protects the user from contact with a tool and/or injury.

Figure 8:
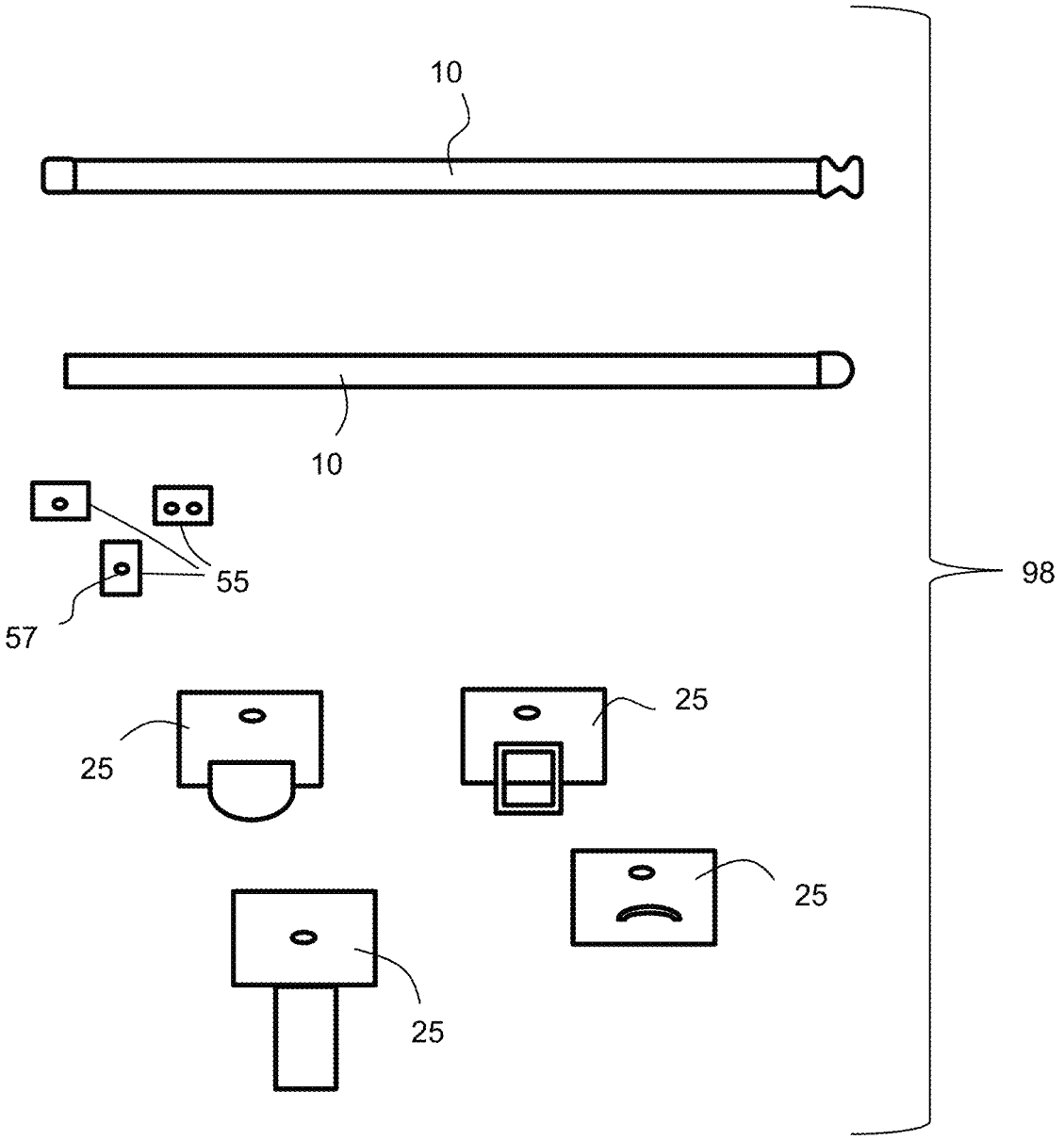
FIG. 8 is a schematic illustrating a kit in accordance with some embodiments of the presently disclosed subject matter.

In some embodiments, the disclosed system can be configured as a kit. Specifically, FIG. 8 illustrates kit 98 comprising one or more straps 10. For example, the straps can vary with regard to type of closure, length, width, etc. The kit can further include a variety of extensions 55 with of various sizes, shapes, and with one or more latches 57. The kit includes a plurality of inserts 25 that can be mixed and matched along the length of the strap to create a customized tool belt.

Figure 9:
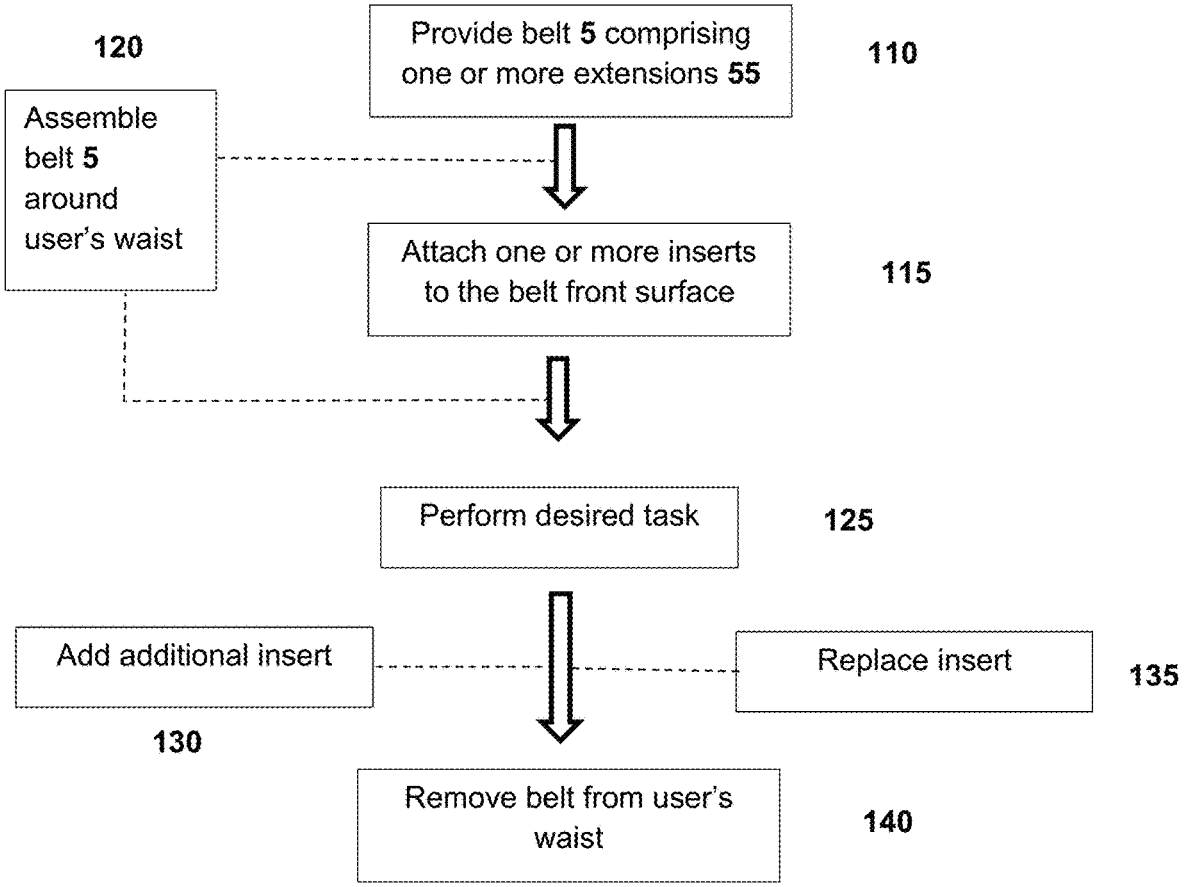
FIG. 9 is a flowchart illustrating one method of using the customizable tool belt in accordance with some embodiments of the presently disclosed subject matter.

In use, belt strap 10 can be customized as desired by the user, as set out in the flowchart of FIG. 9. Specifically, the strap can be customized to include any positioning, number, and arrangement of extensions 55. Each insert includes a latch that interacts with an insert to join a tool or accessory to the strap. Thus, any suitable inserts can be added to the belt strap by joining belt extension latch 57 with insert coupler 95 to form a locking mechanism at steps 110 and 115. In this way, the belt can be configured with a desired number of inserts needed for a particular job or task, arranged according to the user's preferences. Each insert can be joined to the belt strap using any suitable mechanism, such as the use of pressure fit attachment, snap fit attachment, clips, fasteners, joints, and the like. Either before or after the belt has been assembled, it can be secured around the user's waist by activating closure 20 at step 120.

Furthermore, the belt can be worn in positions other than the user's waist. For example, the belt can be draped across the user's shoulder. Alternatively, it can be secured around the user's arm or leg.

The user can perform the desired task at step 125, such as a construction job, concrete work, and/or masonry work. Advantageously, the needed tools and accessories are close at hand on belt 5. Optionally, if an additional insert is needed, it can be easily added to strap 10 (i.e., the insert coupler can be locked into the strap extension) to accommodate the desired tool or accessory at step 130. Alternatively, if the user desires to remove one or more inserts (e.g., to replace with a different insert), it can be easily accomplished by separating the insert coupler from the belt extension. A new insert can then optionally be joined to the accessory at step 135. When the user desires to remove the belt, closure 20 is detached to allow the belt to be removed from the user's body at step 140. The belt can then be stored for later use.

Similarly, if an additional extension is desired to be added to the strap, it can be easily threaded onto the belt or otherwise attached. Further, if the position of a desired extension needs to be adjusted on the strap, the latch can be uncoupled from the belt, allowing the extension to move along the strap length to a new desired location.

The presently disclosed subject matter includes many advantages over prior art tool belts. For example, tool belt 5 is capable of supporting a variety of different tools (e.g., concrete and masonry tools).

In addition, the design of belt 5 allows a user to wear the tool belt to securely hold a variety of tools and accessories in readily accessible locations along the tool belt strap.

The disclosed tool belt is customizable, enabling users to interchange tool inserts to accommodate several different tools as needed (e.g., edger tools, jointers, trowels, hammers, drills, and the like). The tools and accessories are also supported proximate to the hands of a user.

Tool belt 5 is durable and is able to easily withstand a variety of use conditions, such as exposure to hot/cold temperatures, rain, dust, dirt, and the like.

The disclosed tool belt is easy to use, such that even children or the elderly can easily add or remove inserts as needed.

The belt closure allows the belt to be firmly and comfortable worn around the user's waist.

The belt couplers and extensions allow one or more inserts to be easily attached to the belt depending on the user preference and/or a particular job requirement.

Advantageously, the belt allows a user to configure tool belt 5 in a variety of different configurations to accommodate desired tools. In this way, the tool belt saves the user time and effort when locating tools on a worksite, because the needed tools are within reach at all times.

As described above, although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A customizable tool belt comprising:

an elongate strap defined by a first end, a second end, a front face, and a rear face;

a closure configured to releasably join the first and second ends;

a plurality of extensions positioned on the front face of the strap, wherein each extension is defined by an interior passageway sized and shaped to allow the strap to pass therethrough and a latch positioned on one face of the extension, wherein the latch is moveable to pass through the face to extend into the interior passageway;

one or more inserts, each insert comprising:

a front face and a rear face;

a coupler configured to cooperate with an extension latch to releasably lock the insert into position on the front face of the strap;

at least one housing configured to retain at least a portion of a tool or accessory;

wherein the one or more inserts can be added or removed to the front face of the strap as desired by a user to create a customized tool belt.

2. The tool belt of claim 1, wherein the strap has a length of about 20-60 inches and a width of about 0.5-2 inches.

3. The tool belt of claim 1, wherein the strap is constructed from one or more of leather, suede, denim, nylon, polyester, canvas, synthetic leather, and fabric.

4. The tool belt of claim 1, wherein each latch protrudes from the front face of the strap at a distance of about 0.1-2 inches.

5. The tool belt of claim 1, comprising about 1-15 extensions.

6. The tool belt of claim 1, wherein the extensions are non-uniformly dispersed about the front face of the strap.

7. The tool belt of claim 1, wherein the closure is selected from a buckle, snap, clip, hook and loop closure, magnet, fastener, zipper, or combinations thereof.

8. The tool belt of claim 1, wherein the rear face of the insert is non-planar.

9. The tool belt of claim 1, wherein the insert coupler is an aperture.

10. The tool belt of claim 1, wherein the at least one housing is selected from one or more loops, hooks, open compartment, holster, pouch, closed pouch, closed compartment, or leg strap.

11. A method of customizing a tool belt, the method comprising:

adding one or more desired inserts to a tool belt comprising:

an elongate strap defined by a first end, a second end, a front face, and a rear face;

a closure configured to releasably join the first and second ends;

a plurality of extensions positioned on the front face of the strap;

wherein each insert is added to the tool belt by joining the insert coupler with a corresponding tool belt extension, wherein each extension is defined by an interior passageway sized and shaped to allow the strap to pass therethrough and a latch positioned on one face of the extension, wherein the latch is moveable to pass through the face to extend into the interior passageway;

whereby the tool belt can be customized with one or more desired inserts.

12. The method of claim 11, wherein the tool belt comprises about 1-15 extensions.

13. The method of claim 11, wherein the closure is selected from a buckle, snap, clip, hook and loop closure, magnet, fastener, zipper, or combinations thereof.

14. The method of claim 11, wherein the at least one housing is selected from one or more loops, hooks, open compartment, holster, pouch, closed pouch, closed compartment, or leg strap.

15. The method of claim 11, wherein the insert coupler is an aperture.

16. A kit comprising:

a tool belt defined by:

an elongate strap defined by a first end, a second end, a front face, and a rear face;

a closure configured to releasably join the first and second ends;

a plurality of extensions, each extension is defined by an interior passageway sized and shaped to allow the strap to pass therethrough and a latch positioned on one face of the extension, wherein the latch is moveable to pass through the face to extend into the interior passageway;

a front face and a rear face;

a coupler configured to cooperate with an extension to releasably lock the insert into position on the front face of the strap;

at least one housing configured to retain at least a portion of a tool or accessory;

wherein the one or more inserts can be added or removed to the front face of the strap as desired by a user to create a customized tool belt.

17. The kit of claim 16, wherein the tool belt comprises about 1-15 extensions.

18. The kit of claim 16, wherein the closure is selected from a buckle, snap, clip, hook and loop closure, magnet, fastener, zipper, or combinations thereof.

19. The kit of claim 16, wherein the at least one housing is selected from one or more loops, hooks, open compartment, holster, pouch, closed pouch, closed compartment, or leg strap.

20. The kit of claim 16, wherein the coupler is an aperture.

* * * * *